United States Patent [19]

Gibbs

[11] 4,165,252

[45] Aug. 21, 1979

[54] METHOD FOR CHEMICALLY TREATING A SINGLE SIDE OF A WORKPIECE

[75] Inventor: Stephen R. Gibbs, Escondido, Calif.

[73] Assignee: Burroughs Corporation, Detroit, Mich.

[21] Appl. No.: 883,747

[22] Filed: Mar. 6, 1978

Related U.S. Application Data

[63] Continuation of Ser. No. 718,897, Aug. 30, 1976, abandoned.

[51] Int. Cl.[2] ..... H01L 21/312; C23F 1/02

[52] U.S. Cl. ..... 156/655; 156/345; 156/642; 204/38 A

[58] Field of Search ..... 156/636, 637, 640, 654, 156/642, 662, 345, 655, 656, 657, 659; 204/179.1, 129.6, 15, 23, 27, 29, 33, 38 R, 38 A

[56] References Cited

U.S. PATENT DOCUMENTS 4,021,279 5/1977 Hirs ..... 156/654

OTHER PUBLICATIONS

IBM Technical Disclosure Bulletin, vol. 16, No. 5, Oct. 1973, Adjustable Fluid Profile Control for Etching by Hecker, p. 1625.

Chemical Engineers' Handbook, Third Edition, 1950 (copyright), p. 408 (Rotameters).

*Primary Examiner*—William A. Powell

*Attorney, Agent, or Firm*—Joseph R. Dwyer; Mervyn L. Young; Kevin R. Peterson

[57] ABSTRACT

A method for chemically treating a single side of a workpiece, such as for etching or anodizing a semiconductor wafer, comprising, placing such a workpiece face down on a flat centrally apertured, relatively level table having a top or work surface of a size and shape commensurate with the dimensions of the workpiece and introducing the liquid for the chemical treatment between the top surface and side of the workpiece to be treated where the liquid passes over the entire surface to be treated and then returns to its source. The method also includes, for certain applications, a pre-processing of the workpiece by oxidizing the workpiece surface on the side of the workpiece opposite of the one to be treated to be treated to prevent creeping of the liquid around the edges thereof.

6 Claims, 5 Drawing Figures

METHOD FOR CHEMICALLY TREATING A SINGLE SIDE OF A WORKPIECE

This is a continuation of application Ser. No. 718,897, filed Aug. 30, 1976, now abandoned.

BACKGROUND OF THE INVENTION

This invention relates in general to the chemical treatment of a workpiece where it is desired to chemically treat only one side of the workpiece and eliminate the need to process the othre side with a protective coating.

This invention relates, in particular, to chemically treating, as by etching or anodizing, a semiconductor wafer on one side only by a method and apparatus in which the one side of the wafer can be so treated without the need of providing a protective coating on the other side so that the latter side will not react to the chemical treatment as in the case of the presently known methods.

There are many instances when it is desired to perform work on only one side of the workpiece, as for example, in semiconductor processing where it is often only necessary to etch or anodize only one surface of a semiconductor wafer without disturbing the other surface. Whether the process was etching or anodizing the one surface, it has heretofore been necessary to coat the opposite surface with a protective layer to prevent that surface from reacting with the liquid chemical, and in the case of anodization, to immerse most of the wafer into the solution with a positive potential applied to the edge of the wafer, via a clip, and a negative potential applied to the liquid. In this process not all the surface to be anodized was utilized since the clip edge of the wafer must remain out of the solution. Thus, the step of adding the protective coating on the side not to be treated and the loss of the portion of the full wafer were extra costs that increased the ultimate cost of the manufacture of the end product.

Another known prior art method of processing a workpiece, such as a semiconductor wafer where only one side of the wafer is to be chemically treated, is to attach vacuum cups or other attaching means to the other side of the wafer and suspend the side to be treated into the solution to a depth less than the thickness of the wafer. This method is also expensive because of the cost of the attaching means and the difficulties involved in precisely suspending the wafer into the solution so as not to affect the top side of the wafer. The only way to protect the top of the wafer in this method, of course would be to add a protective coating to the top side where the vacuum cups are attached but this also is an additional cost even though this process would eliminate the loss of the area of the wafer where the clip leads were attached in the process described above.

Another method is to attach the waferback to a suction cup covering the entire back surface and making electrical contact within the cup. The fixture is then submerged and only one side is exposed. However, maintaining a perfect seal to the wafer edge under vacuum has proven very troublesome.

OBJECT AND SUMMARY OF THE INVENTION

It is therefore a principle object of this invention to provide a method for chemically processing a single surface of a workpiece in a simple and inexpensive manner eliminating a number of steps in the process in the known prior art, thus reducing the cost of the ultimate end product.

It is more specific object of this invention to chemically treat, such as etching or anodizing, a semiconductor wafer on one side without the need for a protective coating on the other side to protect the latter from the chemical solution.

Another object of this invention is to chemically process a workpiece such as a semiconductor wafer in which the entire side of the wafer is processed without the loss of any area of the wafer due to clipping of the electrode thereto as in the prior art.

This and other objects of this invention are accomplished through the use of a fixture which has a table with a relatively flat, relatively horizontal, top surface for supporting the surface of the workpiece on which work is desired to be performed. The top surface includes at least one centrally located aperture and conduit extending from the top surface to a source of liquid chemical used in processing the workpiece. The workpiece is placed face down on the table so that the surface to be processed is facing the table and liquid chemical is then introduced between the two surfaces through the aperture and allowed to flow over the edge of the table and over the face of the workpiece back to the liquid chemical source. When this fixture is utilized to perform anodization of a semiconductor wafer, electrodes are provided to supply an electrical potential between the liquid and the wafer. The electrical contact for the wafer comprises a freely suspended electrode which will yield to the slight upward movement of the wafer when the liquid is introduced between the wafer and the table. Included in this invention is the provision of additional protection on the opposite surface of the wafer adjacent the periphery thereof to prevent the creeping of the solution around the edges of the wafer in certain applications.

BRIEF DESCRIPTION OF THE PREFERRED EMBODIMENT

Figure 1:
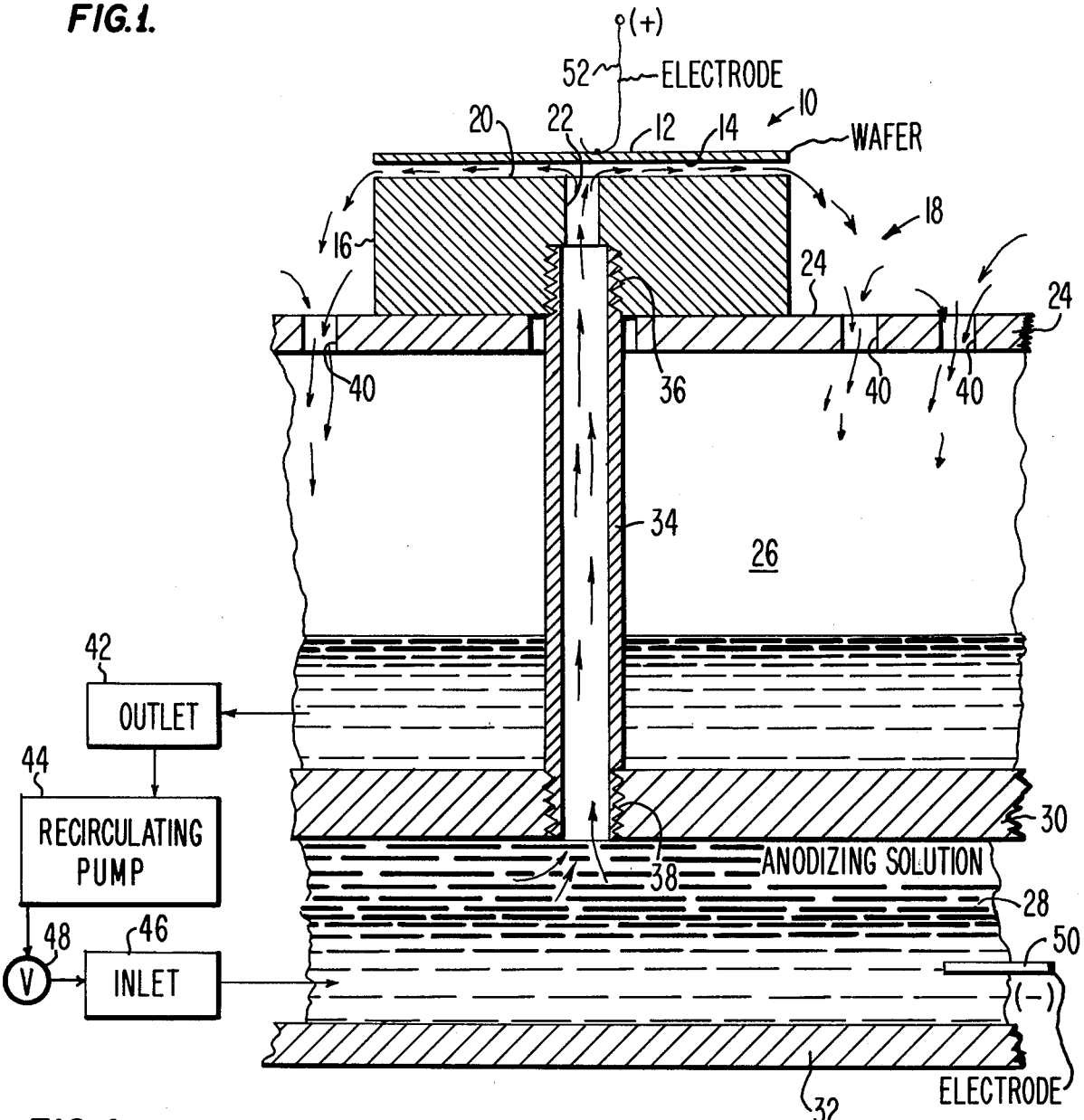
FIG. 1 is a cross sectional diagrammatic partial view of one complete table with the top or work surface and a workpiece supported thereon and showing the means of introducing the liquid chemical to the surface to be chemically treated.

In FIG. I, it can be seen that a workpiece 10, shown as a semiconductor wafer having an upper or top surface 12 and lower or bottom surface 14 is placed on a table 16 of a fixture indicated in its entirety as 18. The bottom surface 14 is the one which is to be chemically treated in accordance with the teachings of this invention.

The table 16 is a disc shaped block having an outer periphery generally corresponding to the periphery of the conventionally circular wafer 10 and includes a relatively flat relatively horizontal working surface 20, centrally apertured as at 22, for supporting the wafer 10. The block is, in turn, supported on a supporting plate 24.

The fixture 16 is divided into an upper liquid reclaim plenum chamber 26 and a lower liquid plenum chamber 28 by dividers 30 and 32 and the lower chamber 28 is in open communication with the aperture 22 in working surface 20 in any suitable manner, such as by tube 34 externally threaded into internally threaded counter bore 36 in the block 16. As shown in the drawings, the lower end of the tube 34 is sealed as by threading at 38 into divider 30 to prevent the liquid in the upper chamber from flowing into the lower chamber. The liquid in the lower chamber 28, utilized to chemically treat the lower surface 14 of the wafer 10, is pumped from the lower chamber through the tubing 34 and the aperture 22 and thus introduced between the two surfaces 20 of the block 16 and 14 of the wafer 10. After spreading over the entire surfaces 20 and 14, the liquid is allowed to drop around the outer edges of the block 16 and to pass through openings 40 in the support plate 24 where the liquid is collected in the upper chamber 26. To recirculate the liquid and to pump the liquid through the tube 34, the chamber 26 is provided with outlet 42 to which is attached a recirculating pump 44 which pumps the fluid into inlet 46 of the lower chamber 28 under sufficient pressure to force the liquid up through the body 16 and introduce the same between the surfaces 20 and 14, respectively. In order to regulate pressure exerted by the liquid as it emerges from the aperture 22 and yet not disturb the general orientation of the wafer 10 in relation to the surface 20, a pressure regulating valve 48 is provided between the recirculating pump 44 and the inlet 46. In addition, for anodizing purposes, a suitable electrode 50 in the lower chamber 28 supplies the negative potential to the liquid and a freely suspended electrode 52 supplies the positive potential to the wafer 10.

For the foregoing, it can be seen that a continuous flow of a liquid chemical such as an anodizing solution, has been provided by the apparatus of this invention and, while the physical phenomena upon which this apparatus relies to perform is not entirely clear, it is believed that it is a combination of gravity, surface tension, and the Bernoulli effect. If this theory is correct, as the liquid flows between the restricted passageway defined by the wafer 10 and the surface 20, the velocity of the liquid increases thereby creating a pressure drop between the surfaces with the result that because of gravity, together with the atmospheric pressure pressing down on the wafer, the wafer is maintained in general orientation with the table surface yet will not slide off the edge of the table due to fluid surface tension around the periphery as long as is necessary for the chemicals to operate on the surface 14. It has been found, for example, that with the rate of flow is about 0.25 gallons per minute passing through the aperture 22 of about 0.25 inches in diameter, over a top surface within 3°–4° of true horizontal, this fixture can be satisfactorily utilized to anodize aluminum or a standard 3.0 inch diameter silicon wafer with a 2% phosphoric acid anodizing solution.

Figure 2:
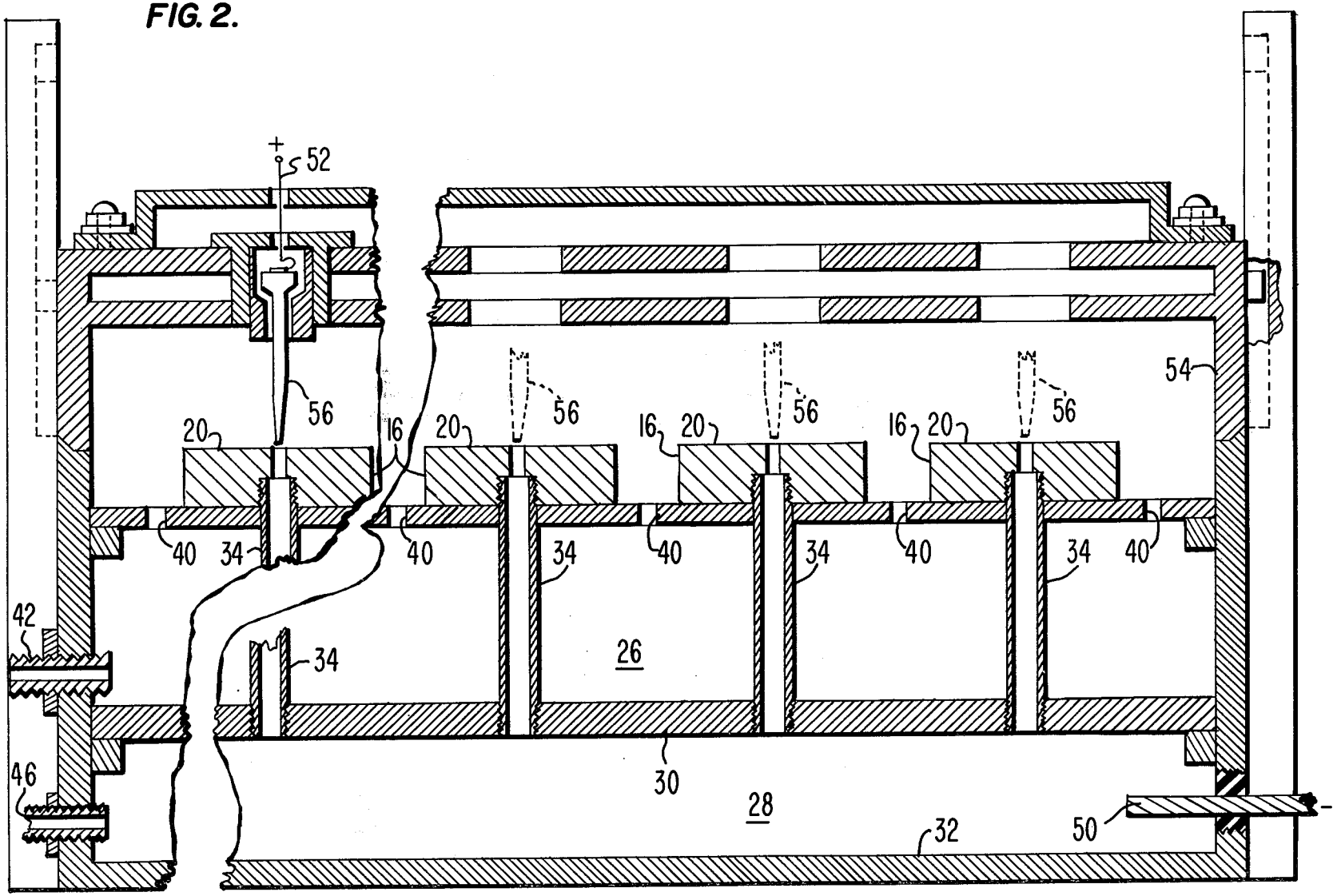
FIG. 2 is a cross sectional view of the apparatus showing a plurality of tables for chemically treating a plurality of workpieces at one time.

Turning now to FIG. 2, one can see that the method can be carried out on a plurality of workpieces at the same time by simply providing additional tables 16. It should be pointed out also in this Figure that the plurality of electrodes 52 are shown connected through the lid 54 of the fixture 12 and shown with pencil-like tips 56 suspended over the wafer as compared to the schematic showing in FIG. 1.

In connection with apparatus shown in FIG. 2 it should be pointed out that to avoid placing the wafers to be treated individually on each table, a large flat vacuum lid or table is utilized, though not shown herein. This vacuum table has an indexing means spaced thereon to locate each wafer corresponding to the location of the corresponding table of the fixture 16. Wafers are placed on this lid and held there by vacuum so that they can be placed face down on the tables when the vacuum is released.

Figure 3:
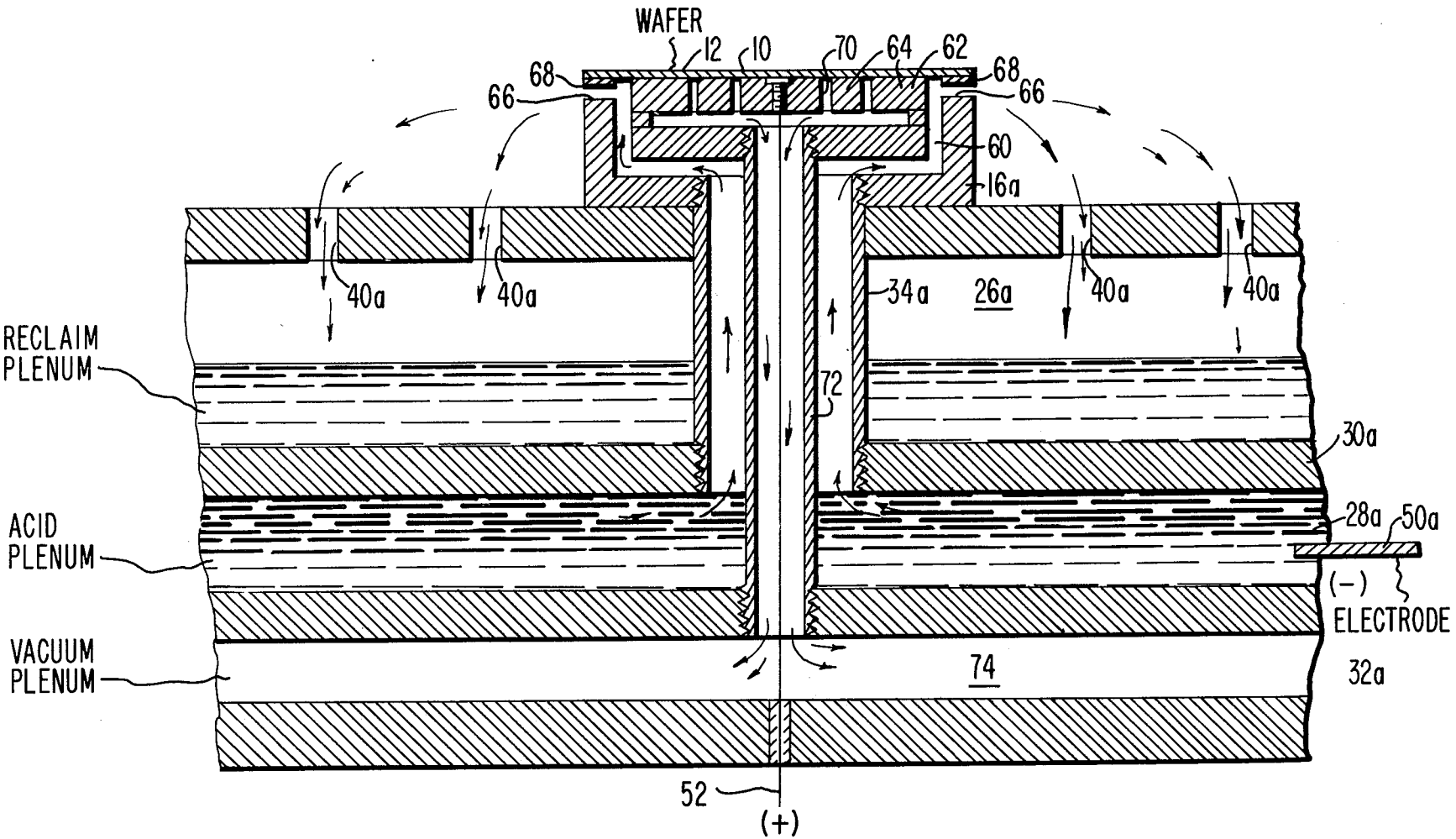
FIG. 3 is a cross sectional diagrammatic view of one table for pre-processing a workpiece for later processing the apparatus of FIGS. 1 and 2.

As hereinabove mentioned in certain applications, it has been found that the liquid for chemically treating the undersurface 14 of the wafer, while flowing out and over the edges of the table in certain applications tends to creep over the outer edges of the wafer and up on to the upper surface 12 particularly near the very edges of the upper surface. In order to prevent this creeping phenomena, in these instances the wafers are preprocessed by oxidizing the edges by anodization in fixture such as shown in FIG. 3. For the same of simplicity in describing the function of FIG. 3 those parts were function is the same or similar to similar parts in FIGS. 1 and 2 will be given the same reference numbers but with a suffix a.

Figure 4:
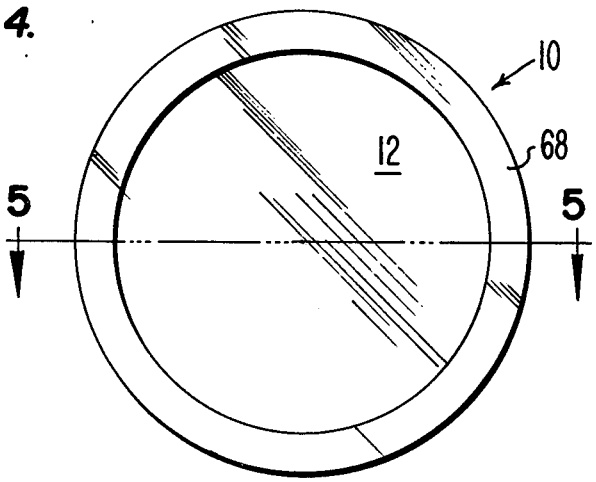
FIG. 4 is a top plan view of a workpiece processed in the apparatus of FIGS. 1–3.
Figure 5:
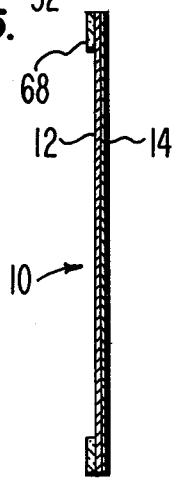
FIG. 5 is a cross sectional view of the workpiece of FIG. 4 taken along line 5—5 and looking in the direction of the arrows.

It is noted in FIG. 3 that the upper and lower plenum chambers are in communication via a tube **34*a* with a Table 16*a*. However, in this case the table 16*a* has been formed with an inner cavity 60 for accommodating a vacuum table indicated in its entirety as the 62, to form a chuck for holding the wafer in position relative to the table 16*a*. The vacuum table is provided with a top surface 64 which is slightly higher than the top surface 66 of the table 16*a* so as to permit the liquid chemical from the lower chamber 28*a* to flow out over the top surface 66 and back into the upper chamber 26*a* in a manner similar to that described in connection with FIGS. 1 and 2. This liquid chemical from the lower chamber chemically treats the outer edges 68 of the wafer as defined by the outer periphery of the top surface 66 and the outer periphery of the vacuum table 64. In order to provide the suitable vacuum for the vacuum table in order to hold the wafer thereon, the vacuum table 62 is provided with a plurality of apertures 70 which are in open communication through a inner conduit 72 to a vacuum chamber 74 which in this embodiment, is located below the two chambers 26*a* and 28*a* and connected to a suitable vacuum source (not shown). It should also be noted that the physical phenomena relied upon to position the wafer in the fixture of FIGS. 1 and 2 is not used in this embodiment since the vacuum table is relied upon to hold the wafer in position as the edges are being treated and it should also be noted that the edges being treated will becom the top of upper side 12 of the wafer 10 as performed in the method and apparatus of FIGS. 1 and 2. The wafer, preprocessed in the apparatus of FIG. 3, is clearly shown in FIGS. 4 and 5 of the drawings with the area identified as 76** showing the oxidized edges in exaggerated form for purposes of clarity.

From the foregoing it can be seen that a new method has been shown and described which will permit a workpiece, such as a semiconductor wafer, to be chemically treated on one side only without the necessity of a protective coating on the other side; but in those applications where the creeping phenomenon is present, and only if, this phenomenon is undesirable, a preprocessing step can be provided in a simple manner. Thus, in connection with the fisture of FIGS. 1 and 2 the procedure to form for example an anodic oxide on the front or lower face of an aluminized wafer is substantially as follows:

1. Load wafer on the tables with the surface to be turned face down on the tables either individually by hand or by the use of a vacuum lid on table,
2. Place electrical contacts touching the wafer backs (top of wafers),
3. Start solution flow and apply desired voltage (5–1000) for desired length of time (3 minutes–2 hours), and
4. Remove wafers, rinse and dry.

In those applications where preprocessing of the wafer is necessary or desirable then the following steps would be taken:

1. Place wafers with the bottom faces down on the vacuum lid on table.
2. Apply vacuum to hold the wafers.
3. Start solution flow and apply voltage (10–100 V) for desired length of time.
4. Remove wafers, rinse and dry.
5. Start steps 1–4 of regular process above.

What is claimed is:

1. A method of chemically treating a workpiece on one surface only comprising the steps of:

placing the workpiece with a surface to be treated horizontally down on a horizontally disposed top surface of a table, said top surface having a centrally located aperture thereon and the workpiece and top surface being coextensive:

introducing liquid chemical in an upward direction through the aperture and across the top surface where said chemical flows between the top surface and the entire surface to be treated with sufficient pressure to space the workpiece from the top surface so that liquid chemical performs the treatment on the entire surface of the workpiece and at the same time utilizing said introduced fluid to alone maintain orientation of the workpiece relative to the top surface during this treatment.

2. The method as claimed in claim 1 wherein said workpiece can be preprocessed by oxidizing the edges of the side of the workpiece opposite the surface to be treated by the liquid chemical in the steps set forth in claim 1.

3. A method of chemically treating an entire surface of a workpiece comprising the steps of:

horizontally orienting workpiece surface so as to face a horizontally oriented top surface of a work table, said workpiece surface and said top surface being coextensive, placing the workpiece surface in contact with said top surface, through a centrally located aperture in said top surface introducing liquid chemicals in an upward direction between said workpiece surface and said top surface with sufficient pressure to separate the workpiece surface from the surface to allow said liquid chemicals to flow over the entire top surface utilizing said introduced liquid chemicals to alone maintain the orientation of a workpiece and concurrently chemically treat said workpiece entire surface.

4. The method as claimed in claim 3 wherein said step of introducing the liquid chemical takes place centrally of both said workpiece surface and said top surface and in an upward direction and flows radially from said place of introduction.

5. The method as claimed in claim 4 wherein the workpiece to be treated comprises a circular semiconductor wafer and said top surface is disk shaped.

6. A method of chemically treating an entire surface of a workpiece comprising the steps of:

horizontally orienting workpiece surface so as to face a horizontally oriented centrally apertured top surface of a work table, said workpiece surface and top surface being coextensive, placing the workpiece surface in contact with said top surface, separating said surface and said top surface by the introduction of upward flowing liquid chemical under pressure between the workpiece surface whereby the liquid chemical lifts said workpiece and flows entirely over said top surface and engages the entire area of said workpiece surface thus concurrently chemically treating said workpiece surface, and maintaining the orientation of said surface relative to said top surface by said liquid chemical.

* * * * *